United States Patent [19]

Micheletti

[11] Patent Number: 5,062,438

[45] Date of Patent: Nov. 5, 1991

[54] WASHING APPARATUS AND PROCESS

[76] Inventor: Bejrouth M. Micheletti, 1258 Hollyfield Crs., Oakville, Ontario, Canada, L6H 2J6

[21] Appl. No.: 396,362

[22] Filed: Sep. 28, 1989

[51] Int. Cl.[5] ..... B08B 1/02; B08B 3/04

[52] U.S. Cl. ..... 134/9; 134/12; 134/15; 134/26; 134/29; 134/31; 134/42; 134/60; 134/72; 134/107; 134/131; 15/77; 15/210 A; 15/302

[58] Field of Search ..... 15/77, 210 A, 302; 134/60, 72, 107, 131, 15, 29, 31, 42, 26, 9, 12

[56] References Cited

U.S. PATENT DOCUMENTS

| | | | |
|---|---|---|---|
| 2,263,624 | 11/1941 | Goetz et al. | 15/210 A |
| 2,279,691 | 4/1942 | Long et al. | 15/77 |
| 2,410,934 | 11/1946 | French | 15/210 A |
| 4,589,926 | 5/1986 | Holmstrand | 134/12 |

*Primary Examiner*—Theodore Morris
*Assistant Examiner*—Zeinab El-Arini
*Attorney, Agent, or Firm*—McConnell and Fox

[57] ABSTRACT

A venetian blind or similar flexible flat article is held in tension on a foraminous belt and passed through washing, rinsing and drying zones. The condensate from the air from the drying zone is used as final rinse. The slats of the blind are held at a slight angle to improve drainage and prevent sag or the blind below the edge of the belt.

7 Claims, 4 Drawing Sheets

WASHING APPARATUS AND PROCESS

FIELD OF THE INVENTION

This invention relates to an improved apparatus and method of washing venetian blinds and other flexible flat objects such as rugs and screens.

DESCRIPTION OF THE PRIOR ART

Venetian blinds are normally constructed of a plurality of rotatable and reversible slats that can be positioned to provide open space relationship or closed in overlapping contact. Removing dust, smoke, finger marks and other foreign matter from such blinds is a difficult and tedious task if performed by the usual hand methods. Previous processes have been suggested for washing blinds, for example, U.S. Pat. No. 2,279,691 discloses an apparatus wherein a venetian blind is hung on a track which carries it through a series of washing and drying stages within an apparatus. In this apparatus the frame is suspended from the top in its normal operating position.

An alternative approach is shown in U.S. Pat. No. 2,682,676 where the washing apparatus is brought to the installed blind and mounted on the windowsill with the blind raised and the blind is lowered within the apparatus. The whole washing procedure is carried out within this single apparatus which therefore must provide both washing and drying facilities.

A further alternative means is shown in U.S. Pat. No. 2,273,514 where the blind is fed through a washing machine in the horizontal position, that is with the slats lying in a horizontal position and passing through a washing tub.

A further alternative has been proposed in the past in which the venetian blind is removed from the window and mounted on an open belt on a machine with the belt lying in a vertical plane and the blind stretched over the surface of the belt with the slats in a vertical position. The blind is then passed through the machine on the belt through various stages where it is washed, rinsed and dried and then passed to an unloading stage where the blind is removed from the belt.

All of the foregoing processes have certain problems, in the case, for example, of the system disclosed in U.S. Pat. No. 2,683,676 the apparatus is cumbersome and requires various supply lines which may be difficult to provide in the location of the blind. It is evident that it would be more convenient to remove the blind and place it within a washing apparatus, as, for example, in the case of U.S. Pat. No. 2,279,691. In that apparatus and process, however, there is a problem with maintaining the length of the ladders which are made of fabric and support the slats. These tend to shrink during the washing process.

In addition, all of the previous processes, when permitting drainage of the fluids from the slats do not orient the slats in the most advantageous position to ensure minimum spotting and maximum drainage to ensure a clean surface and edge after rinsing. All of the previous systems while taking some effort to minimize drainage marks, nevertheless still leave marks on the blinds after they are rinsed and dried.

SUMMARY OF THE INVENTION

In accordance with the present invention, the article to be washed is removed from its installed location and placed in a machine where the washing process occurs.

This machine consists of an open belt on which the article is held, preferably in tension, lying against a belt, which is in a vertical position, but at an angle along the belt from the vertical. The article is then passed through the apparatus where an improved washing process occurs consisting of a washing stage, at least one rinsing stage and drying stage. In accordance with this invention, the final rinsing stage is performed by condensate extracted from the system, thus ensuring that any minerals present in the normal water supply are not precipitated on the article during the drying process since the final rinse consists of distilled water which should be completely mineral-free. In addition, the oblique angle of the article ensures that it does not sag and hang below the lower edge of the belt and thus interfere with the belt drive and support mechanism and, in addition, improves drainage.

A clearer understanding of my invention may be had from a consideration of the following description and drawings.

Figure 1:
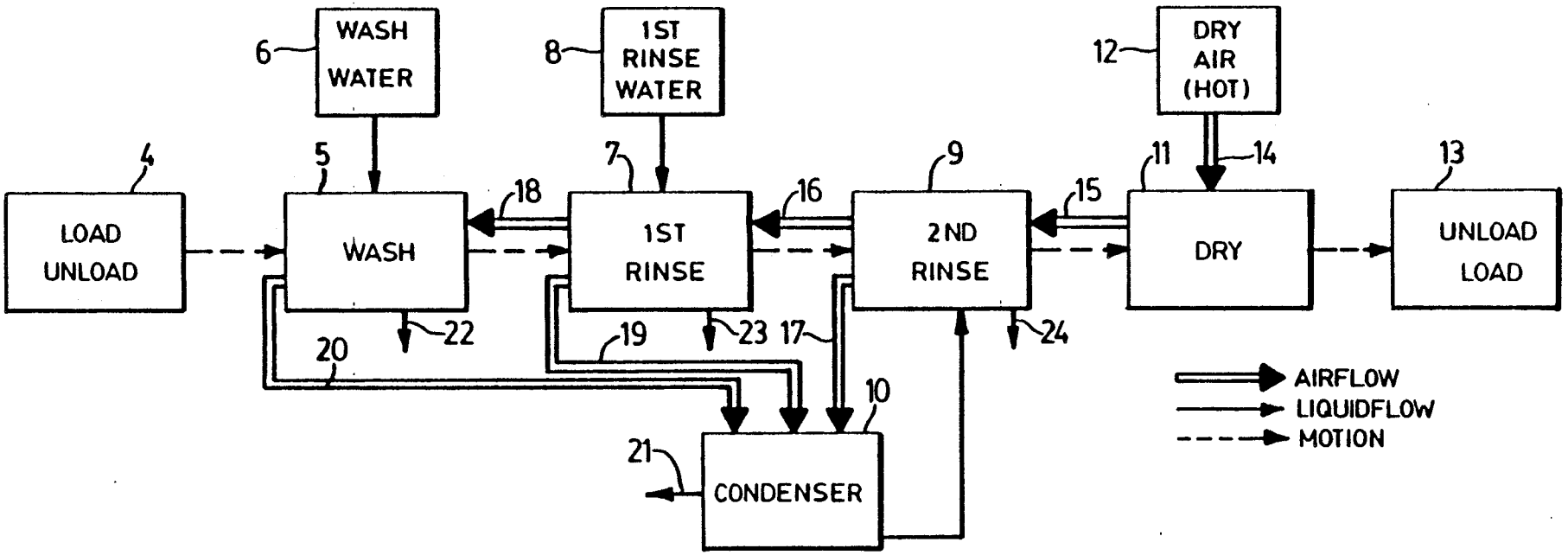
FIG. 1 comprises a block diagram of the process in accordance with my invention.

Considering first FIG. 1, there is shown a block diagram of the process of my invention. It will be seen that the articles are loaded at the block designated 4 the "load, unload" zone. They then move, as indicated by the dotted arrow, to zone 5 where they are washed with a jet of detergent water provided from the wash water source 6. They then pass on to zone 7 where they are spray rinsed with rinse water from the first rinse water source 8. They then pass, as indicated by the dotted arrow, through the second rinse 9 where they are spray rinsed with condensate from the condenser 10. They then pass, as indicated by the dotted arrow, to the dry stage 11 where they are exposed to a current of dry, hot air provided by the source 12. The flow of air is indicated by double arrows.

The articles now proceed to zone 13, the unload zone, which may coincide with zone 4 in the machine, in other words articles may be loaded and unloaded at the same locations on the machine if so desired.

It will be seen that the hot air supplied by source 12 flows, as shown by arrow 14, into the drying zone 11 and then, as shown by arrow 15, into the second zone stage 9. A portion of the air leaks back from the second rinse to the first rinse, as shown by arrow 16, but the major portion flows down to the condenser, as shown by arrow 17. A portion of the air which flows through the rinse zone 7 flows back to the wash zone 5, as indicated by arrow 18, while a further portion flows down to the condenser as indicated by arrow 19. Any flow of air through the wash process zone 5, indicated by arrow 18, flows out, as shown by arrow 20, to the condenser, thus all the vapor-laden air from the drying zone, the rinsing zones and the washing zone flows eventually to condenser 10 where, by means of a suitable source of cooling, either by water flow or by refrigeration, the air is chilled and the condensate extracted.

The cooled, dried air leaves the condenser, as shown by arrow 21, to atmosphere or may be returned to the dry air source 12 as desired. The wash water supplied by source 6, after washing the article in the wash zone 5, drains from the wash zone, as indicated by arrow 22, and may be returned to the wash water source 6 or may be discarded. Similarly the rinse water from rinse water source 8 drains from the first rinse as indicated by arrow 23 and this again may be used or discarded. Similarly the final rinse water in the second rinse stage 9 leaves the zone, as indicated by arrow 24, and may be returned to the first rinse water source 8 or discarded.

The structure of the apparatus used for washing venetian blinds in the process may be seen in FIGS. 2–5. The blind 29 is mounted on an openwork belt 30 comprising a number of vertical rods 31, 31*a*, 31*b*, etc. These rods are held at their upper and lower ends by couplers, such as couplers 32 and 33 respectively, which support rod 31*d* (as shown in more detail in FIGS. 4 and 5). These couplers are mounted on cables 34 and 35. The upper couplers 32 are fastened to bogeys 36, 36*a*, 36*b*, etc. which run in tracks such as track 37 at the top of the machine and thus provide the suspension for belt 30. The midpoints of the rods are joined by suitable means to a cable 50 which stabilizes the rods and adds to the rigidity of the belt.

The belt comprising cables 34 and 35 and the associated couplers and rods, passes around a pair of sprockets at each end of the apparatus. As may be seen, the upper left hand sprocket designated 38 is mounted on a shaft 39 (see FIGS. 4 and 5) and the lower left hand sprocket 40 is mounted on the same shaft. This shaft is suitably mounted for rotation in bearings (not shown).

Similar sprockets 41 and 42 are mounted on the top and bottom of a shaft 43 at the right hand side of the machine. This shaft is also mounted for rotation in bearings (not shown) and arranged to be driven by an electric drive 44. Rotation of shaft 43 by the electric drive causes sprockets 41 and 42 to rotate driving belt 30 around the sprockets by virtue of the engagement of the couplers with the notches in the sprockets. The belt 30 then moves from right to left across the front of the machine carrying the blind 29 around the end of the machine where the belt passes around sprockets 38 and 40, then left to right across the back of the machine and then back around sprockets 41 and 42.

The bogeys 36 are supported at the back of the machine by a track 37*a* similar to track 37 at the front of the machine.

Figure 2:
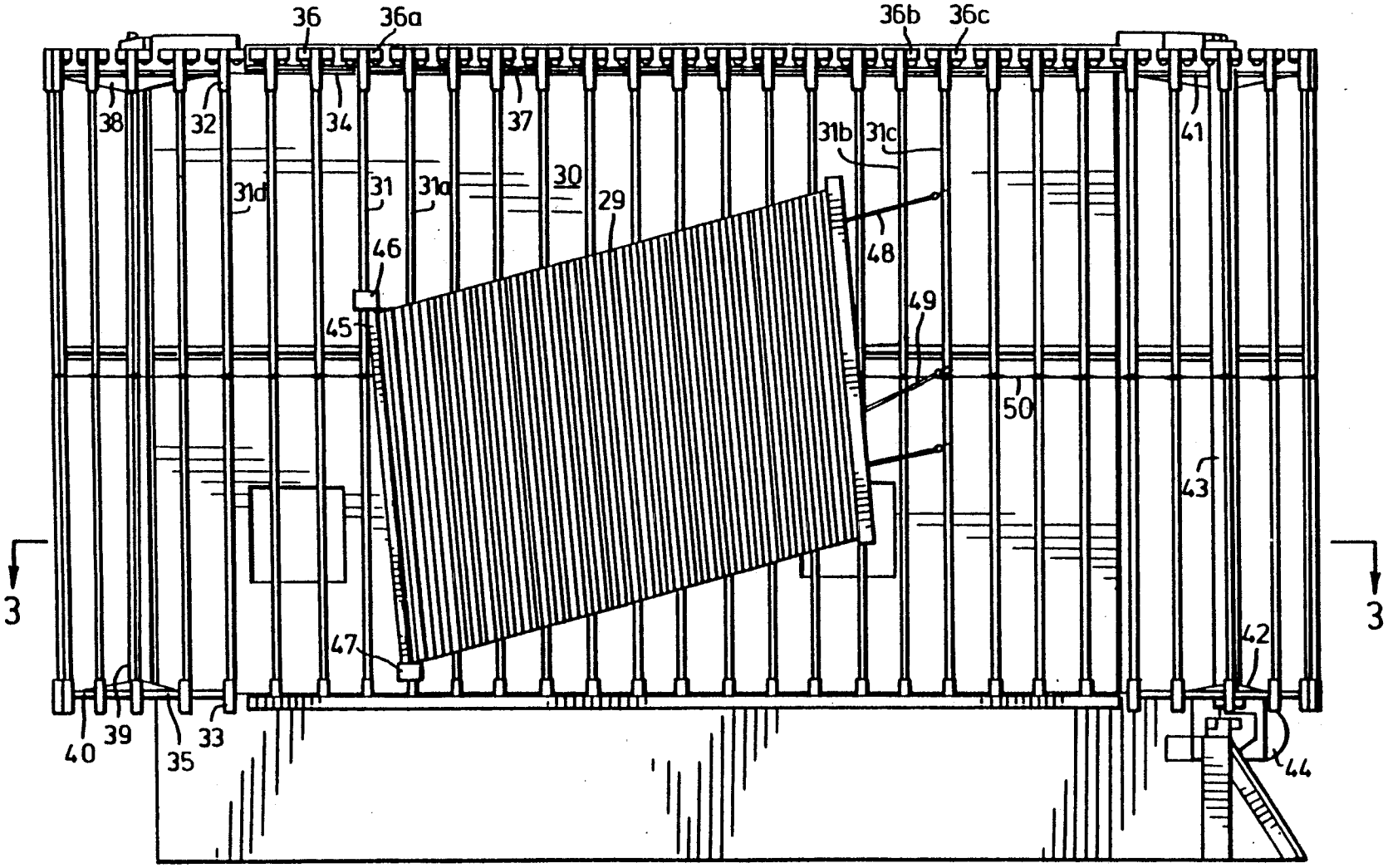
FIG. 2 is an elevational view of the apparatus used in carrying out the process.

As may be seen in FIG. 2, the blind to be washed is mounted by its header 45 in a pair of mounting brackets 46 and 47 which are mounted on adjacent rods 31 and 31*a* respectively. When so mounted, the header is at a slight angle from the vertical thus tilting all the elements of the blind at a small angle.

The other end of the blind is stretched taut and at an upward angle by means of a number of rubber tension straps 48 and 49. Strap 49 is clipped to rod 31*c* at a point above the centre of the rod and is prevented from slipping down the rod by its engagement with cable 50 and its fastener, thus maintaining the angular position of the blind. Tension straps 48 and 49 are connected to rods 31*c* at a suitable location to ensure that the blind is maintained in substantial tension during the washing process.

Figure 3:
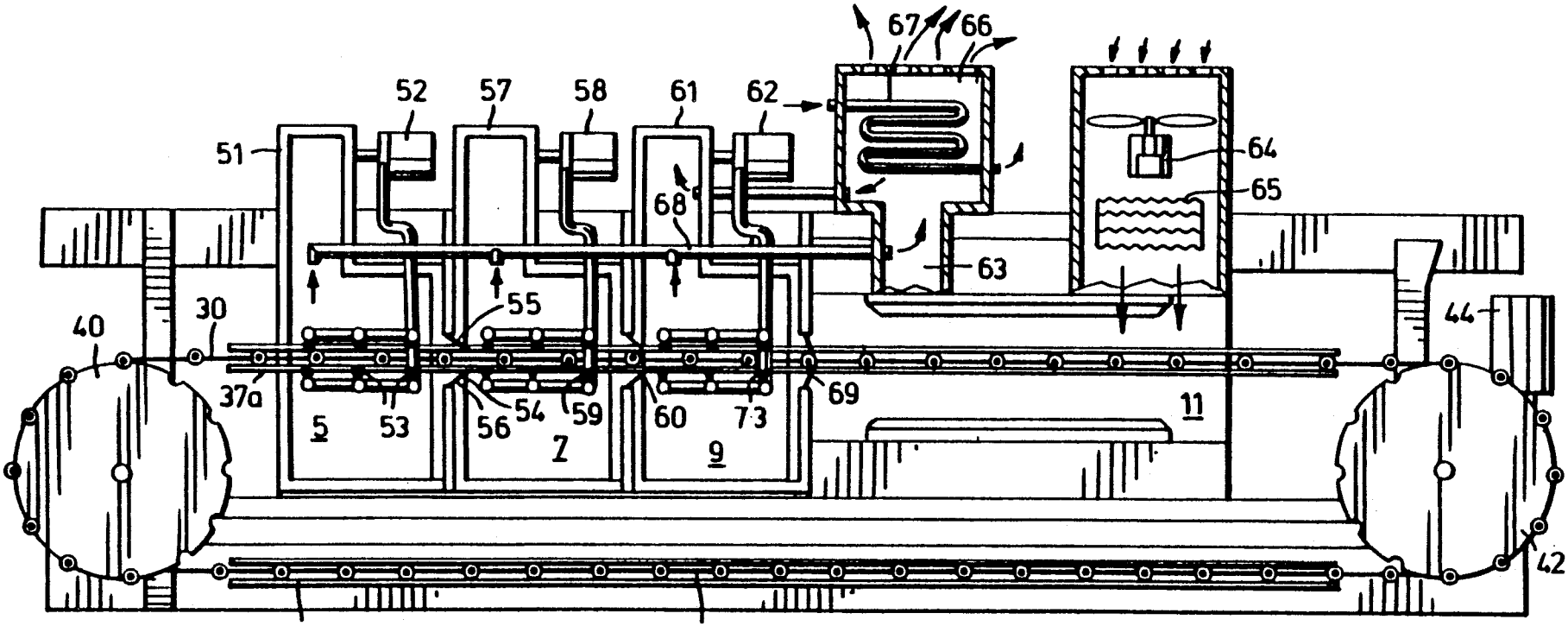
FIG. 3 is a plan view of the apparatus of FIG. 2 at section 3—3, partly in section.
Figure 4:
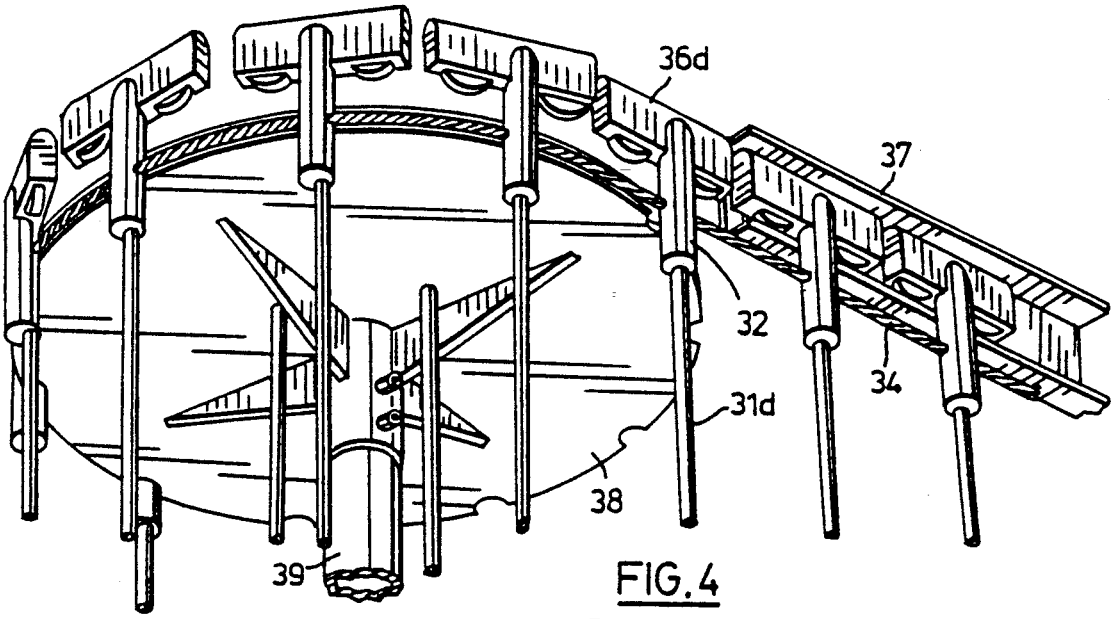
FIGS. 4 and 5 are details of the apparatus of FIG. 2.
Figure 5:
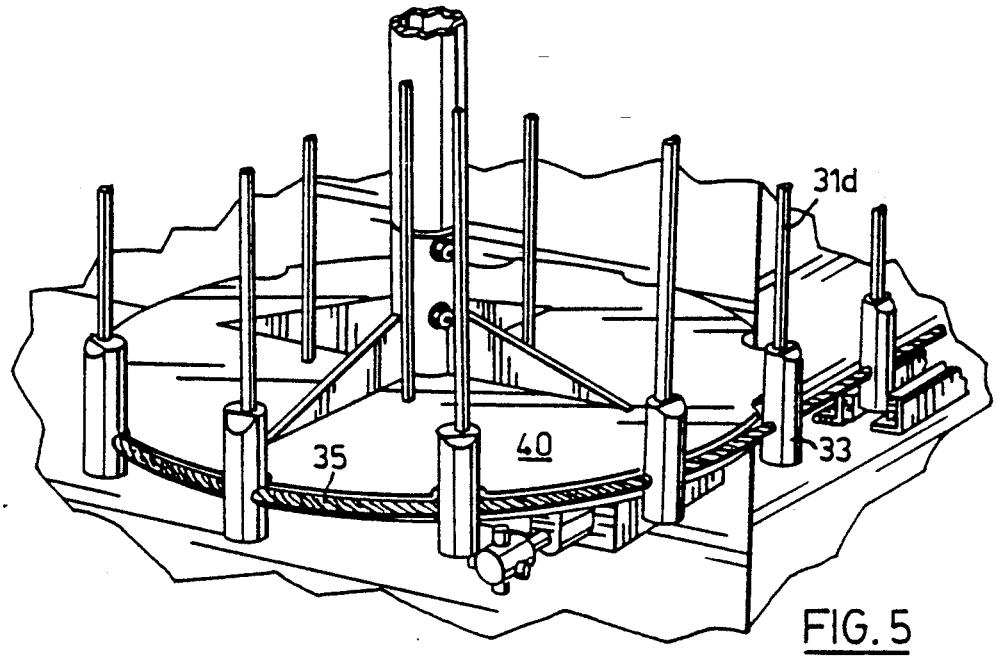

As may be seen in FIG. 3, the belt 30 passes around behind the machine and through the various stages set out in FIG. 1. It first passes into a chamber 51 which comprises wash stage 5. Here a suitable detergent containing washing fluid is pumped by pump 52 through a plurality of jets 53 which provide a spray pattern that completely sprays both sides of the belt and any blind mounted on the belt.

The belt 30 now passes through a flexible shield 54, which consists of a pair of flexible leaves 55 and 56 of plastic or suitable rubbery material, into a second chamber 57 which comprises rinse stage 7 where water is pumped by pump 58 through a plurality of jets 59 similar to jets 53. The rinse water may be plain water or may include a suitable surfactant to reduce spotting.

The belt now passes through flexible shield 60 similar to shield 54 and into a third chamber 61 which comprises rinse stage 9. Once again a pump 62 pumps the liquid in the stage through jets 73 which spray both sides of the belt 29.

The belt now passes into chamber 63 which comprises drying stage 11. Drying air is supplied by fan 64 driven by a suitable electric motor. The air is heated by resistance heater 65 and flows, as shown by the arrows, into chamber 11 where it evaporates the water from the blind and dries the blind. The vapour laden air from stage 11 passes into condenser 66 where it is cooled by a liquid cooled coil 67. The flow of liquid is indicated by the arrows at the inlet and outlet of the cooling coil. The cooled air passes out to atmosphere as indicated.

Moisture laden air from chambers 51, 57 and 61 is conducted through duct 68 into the condenser. Any leakage of air from chamber 63 through shield 69 to chamber 61 or from chamber 61 through shield 60, etc. causes moisture laden air to enter duct 68 and thence to the condenser. It may be necessary to introduce a blower into duct 68 to provide sufficient pressure differential to cause the air from duct 68 to be forced into the condenser. As described in explaining FIG. 1, it is desirable that all the moisture laden air, but no liquid droplets, be extracted from the washing and rinsing stages to provide sufficient fresh uncontaminated water for the final rinse stage.

As will be seen, the apparatus provides a convenient means for processing the blinds in accordance with the process described earlier. It will be obvious, however, that numerous re-arrangements and modifications of the apparatus may be made all within the scope of the present invention.

When used to wash area rugs it is evident they may be supported on the belt at an angle by elastic straps at the ends in a manner similar to venetian blinds. Vertical strip blinds may also be similarly supported with their slats in a substantially vertical position. Flexible plastic lenses from fluorescent light fixtures and other narrow or flexible screens may be processed in a similar manner by mounting on the belt with suitable jigs or fixtures which will hold the articles in place during washing and not interfere with complete washing on both sides and proper draining. Any flat objects small or flexible enough to pass around the sprockets of the apparatus and of a material suitable to withstand the washing fluid may be processed on the apparatus and, due to the particular structure of the apparatus and the process used, will emerge clean and free from streaks, spotting or drain marks which might be caused by unremoved detergent, surfactant or minerals in the rinse water.

I claim:

1. A method for washing flat, flexible articles, comprising mounting the article on a foraminous belt lying in a vertical position passing the belt bearing the article through a plurality of water washing, rinsing and drying zones, extracting the moisture laden air from at least the said drying zone, condensing the water from the moisture laden air, utilizing the said condensed water for rinse water in at least the final of said rinse zones.

2. A method as claimed in claim 1 wherein a final rinse zone uses only said condensed water.

3. A method as claimed in claim 1 wherein said flexible articles are held in tension on said belt.

4. A method as claimed in claim 3 wherein said flexible article is rectangular and the article is held with one of its rectangular sides at a slight angle to the horizontal.

5. A method as claimed in claim 3 wherein the said flexible article is a venetian blind having slats and said slats are arranged to lie on the belt with their axis at a slight angle to the perpendicular.

6. An apparatus for washing venetian blinds comprising a foraminous belt which passes around a plurality of sprockets and is held in a vertical position by said sprockets, means to support said blind on said belt whereby said blind lies in the same plane as said belt, means to cause said belt and thereby said blind to pass through a plurality of washing, rinsing and drying zones, means to spray both sides of said belt and said blind with washing fluid in said washing zone, means to spray both sides of said belt and said blind with rinsing fluid in said rinsing zones, means to pass hot, dry air over said belt and said blind in said drying zone, means to cool air from at least said drying zone, means to collect the resulting condensate and means to use said condensate as rinsing fluid in at least one of said rinsing zones.

7. Apparatus as claimed in claim 6 wherein said means to support said blind on said belt includes means to maintain said blind in tension.

* * * * *